United States Patent [19]

Lehmacher

[11] 4,395,252

[45] Jul. 26, 1983

[54] APPARATUS FOR MAKING BAGS OF THIN SYNTHETIC-RESIN FILM

[76] Inventor: Hans Lehmacher, Im Hummerich, 5216 Niederkassel-Mondorf, Fed. Rep. of Germany

[21] Appl. No.: 265,547

[22] Filed: May 20, 1981

[30] Foreign Application Priority Data

May 24, 1980 [DE] Fed. Rep. of Germany ..... 302009

[51] Int. Cl.[3] ..... B31B 23/02; B31B 23/14

[52] U.S. Cl. ..... 493/28; 493/196; 493/204; 493/926

[58] Field of Search ..... 493/204, 203, 193–196, 493/201, 200, 926, 28; 156/556, 558, 559, 563, 299, 253, 510

[56] References Cited

U.S. PATENT DOCUMENTS

| | | | |
|---|---|---|---|
| 1,735,609 | 11/1929 | Frederick | 156/556 |
| 2,667,019 | 1/1954 | Feyrer | 493/382 |
| 3,493,450 | 2/1970 | Judge, Jr. | 156/563 |
| 3,893,382 | 7/1975 | Bosse et al. | 493/194 |
| 3,908,522 | 9/1975 | Bender | 493/204 |
| 3,970,508 | 7/1976 | Gossie | 156/556 |
| 4,083,747 | 4/1978 | Rochla | 156/510 |
| 4,268,346 | 5/1981 | Achelpohl | 493/194 |
| 4,308,021 | 12/1981 | Achelpohl | 493/204 |

FOREIGN PATENT DOCUMENTS

| | | | |
|---|---|---|---|
| 2059630 | 7/1979 | United Kingdom | 493/196 |

*Primary Examiner*—Nicholas P. Godici

*Assistant Examiner*—Kurt Rowan

*Attorney, Agent, or Firm*—Karl F. Ross; Herbert Dubno

[57] ABSTRACT

Bags are made from an elongated synthetic-resin tube by an apparatus having an endless conveyor having a transport path extending from an upstream cutting-/welding station through a stacking station and a flattening station to a downstream punching station. This conveyor has a plurality of platforms having predetermined lengths in the transport direction and spaced apart by gaps. The tube is fed continuously in the transport direction to the upstream cutting/welding station that periodically transversely cuts through the tube and simultaneously forms upstream of each cut a transversely weld for subdividing the tube into a succession of bag blanks. The stacker includes a transversely reciprocal needle bar including at least one heated blocking needle and a transversely reciprocal stripper bar. The upstream end of each bag blank is pierced by the needles as it is cut off the tube, with the downstream portion of each bag blank lying on one of the conveyor platforms. Periodically the stripper bar is moved upwardly to strip an entire stack of bag blanks off the needles. A flattening device engages each of the bag blanks as it is cut free from the tube and presses it down against the stack on the platform. A gripper carriage is displaceable and has a holding element displaceable vertically so that this holding element can press the stack down against the conveyor as the conveyor is stepped to move this stack down to a punching station.

6 Claims, 6 Drawing Figures

APPARATUS FOR MAKING BAGS OF THIN SYNTHETIC-RESIN FILM

FIELD OF THE INVENTION

The present invention relates to an apparatus for making bags from an elongated synthetic-resin tube. More particularly this invention concerns such an apparatus for making bags of a very thin film.

BACKGROUND OF THE INVENTION

It is known to make bags from a synthetic-resin tube in accordance with the procedure such as described in my copending application Ser. No. 127,064 filed Mar. 4, 1980 (now U.S. Pat. No. 4,333,298 issued June 8, 1982). The tube is delivered to a cutting/welding station where simultaneously it is engaged by an upstream welding bar that forms a transverse weld across the tube, and by, immediately downstream of the seam, a blade which transversely cuts the tube through, creating a bag blank whose downstream end has already been sealed in the previous cutting operation. This blank is then transported downstream, normally either by a conveyor or a drum, to a stamping station where the open upstream end is punched out to form handles. It is also known to stack the bag blanks immediately downstream of the cutting/welding station and to transport this stack downstream for simultaneously punching out the handles of all of the bags in the stack.

Such a procedure works relatively well so long as relatively thick film is used. With thick film the bag blanks are relatively easy to handle and can be counted on to lie flat on top of one another. When thinner film is used, however, it is normally necessary to greatly decrease production speed due to the considerable difficulty of handling the thin film. What is more, it is almost impossible to neatly stack bags formed of extremely thin film, since air is normally captured in and between the bags so that a puffy and hard-to-handle stack is produced.

It has been suggested to block the stack of bags together, normally by forming a small weld through the entire stack. This can simply be done by passing a heated needle through the portion of the stack that is later cut away at the punching station. This heated needle forms a weld that secures together all of the bags of the stack.

This type of blocking is relatively effective, once again, for thick film. Nonetheless when thin film is used it is still quite difficult to transport a stack of bag blanks, even when same have been blocked together in the above-described manner.

OBJECTS OF THE INVENTION

It is therefore an object of the present invention to provide an improved apparatus for making bags of a synthetic-resin tube.

Another object is to provide such an apparatus which can operate relatively rapidly even with relatively thin synthetic-resin film.

SUMMARY OF THE INVENTION

These objects are attained according to the instant invention in an apparatus having an endless conveyor having a stretch defining a transport path extending in a transport direction from an upstream cutting/welding station through a stacking station and a flattening station to a downstream punching station. This conveyor has an endless support element, normally a pair of chains, and a plurality of groups of rigid transverse bars forming along the path a plurality of respective platforms having predetermined lengths in the transport direction and spaced apart in this direction by gaps. The bars of each platforms engage one another in the direction along the transport path, and are in fact only separated from one another at the turn-around areas of the conveyor. The synthetic-resin tube is fed generally continuously in the transport direction to the upstream cutting/welding station which is provided with cutting-/welding means that periodically transversely cuts through the tube and generally simultaneously forms upstream of each cut a transversely throughgoing weld so as to subdivide the tube into a succession of bag blanks. Stacking means is provided in a stacking station immediate downstream from the cutting/welding station and includes a transversely reciprocal needle bar provided with a plurality of needles including at least one heated blocking needle, and transversely reciprocal stripper bar through which the needles engage. The conveyor, cutting/welding means, and stacking means are synchronously operated by a controller that pierces the needles through the upstream edge of each of the bag blanks as same is cut free from the tube while supporting each of these bag blanks as they are cut free from the tube on one of the platforms. In addition after a predetermined number of operations of a cutting-/welding means the bag blanks are stripped by the stripper bar off the needles and the conveyor is operated to displace the stack of bag blanks freed from the needles downstream to the punching station.

According to this invention flattening means is provided in the flattening station immediately downstream of the stacking station and has a plurality of flattening elements which engage each bag blank as it is cut free from the tube and press it flatly down either against the platform or against the underlying bag blank so as to form a flat and smooth stack. This flattening means therefor drives the air from inside the bag while simultaneously driving out air between the bag so that the stack will be relatively dense even though relatively thin film is being used.

In addition to aid in displacement of the stack from the stacking station of the punching station a gripper carriage is provided which is displaceable in and against the transport direction and which has a holding element displaceable vertically down toward and up away from the conveyor. The control means is connected to this carriage and operates the holding element to press it down against the stack of bag blanks as they are stripped from the needle bar and for thereafter displacing the carriage synchronously codirectionally with the platform supporting the stack downstream to the punching station. In the manner this stack of bags is held securely down on its platform as it is moved downstream from the stacking station to the punching station.

At the punching station the upstream edges of the bag blanks in the stack are punched out to form needles, perforations are formed, or any other similar punching operation is carried out on the entire stack of bag blanks. This punching station is spaced in the transport direction downstream of the welding/cutting station by a distance which is substantially greater than the predetermined length of the platforms, so that the punch can act between platforms on the upstream bag/blank edges which according to this invention overhang the upstream edge of the platforms supporting them. In fact the platforms are normally somewhat shorter than the bag blanks, so that the blanks overhang them at both ends.

It is possible according to this invention to remove the support bars from the endless support of the conveyor so as to vary the length of the platforms and the dimensions of the gaps between them.

With the system according to the instant invention, therefore, as each bag blank is cut free from the tube it is positioned along with the previously severed bag blanks of the same stack on the needles and it is individually smooth and flattened out on top of the stack. A deflecting plate is normally provided to insure that as each stack is gripped and transported away the next arriving bag is able to move into position above where its stack will be formed. Thus with the system according to the instant invention in an extremely simple manner it is possible to work with the normally difficult fine film now used in many bags.

SPECIFIC DESCRIPTION

Figure 1:
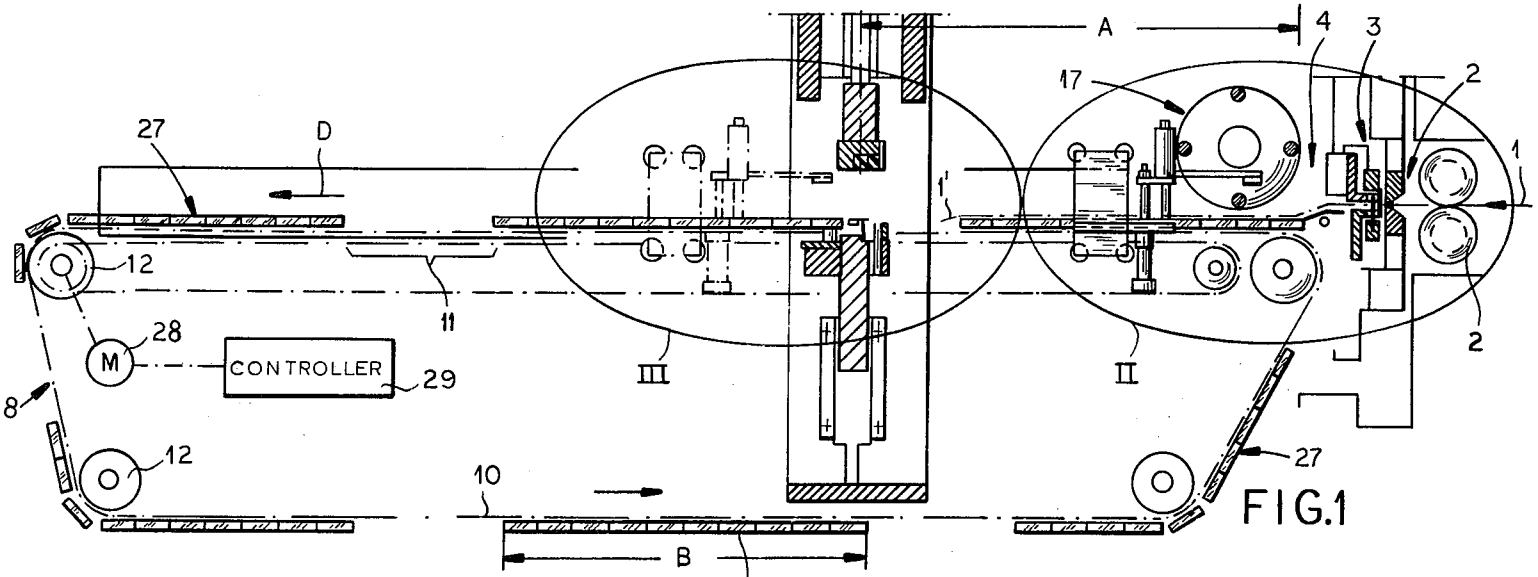
FIG. 1 is a partly schematic side view of the apparatus according to this invention.
Figure 4:
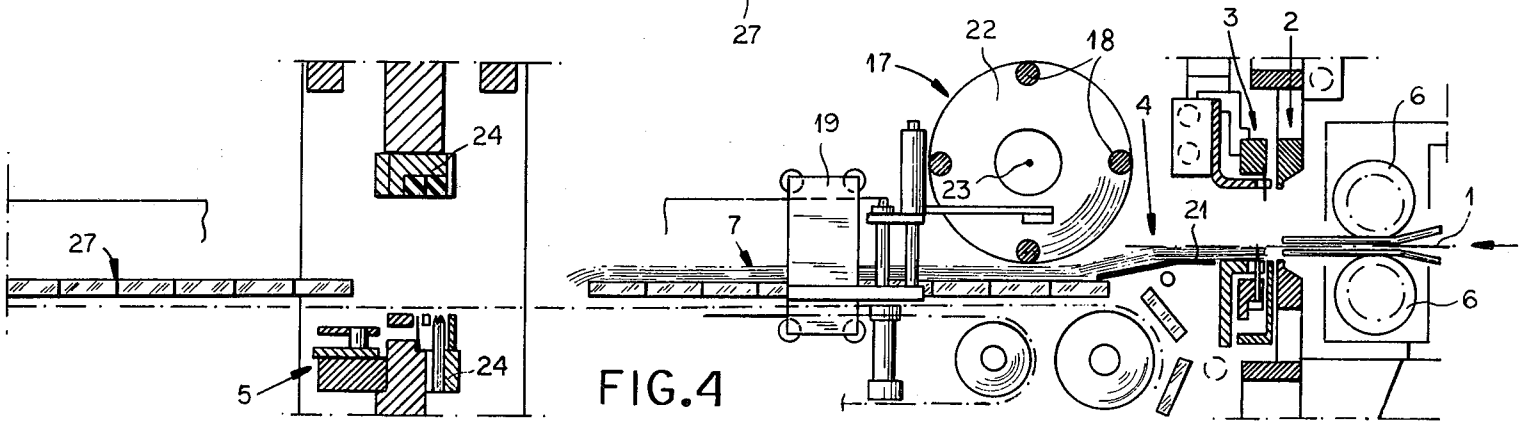
FIGS. 4, 5, and 6 are views similar to FIG. 1 showing how the apparatus according to the instant invention functions.

The apparatus according to the instant invention as shown generally in FIG. 1 basically comprises an endless conveyor 8 having an upper stretch movable in and defining a transport direction D and extending at this upper stretch sequentially through a welder 2, a cutter 3, a stacker 4, a flattener or smoother 17, and a stamper or puncher 5. These units subdivide a synthetic-resin tube 1 that is fed in by feed rollers 6 into a succession of bag blanks 1' that are piled up into stacks 7 and subsequently punched into bags of the shopping or handle type such as described in my above-cited copending application.

The conveyor 8 comprises a pair of chains 10 extending over rollers 25 and carrying groups of transverse rigid bars 9 secured as illustrated in FIG. 1 by means of removable screws and bolts 26 to the chains 10 to form tables or platforms 27 each having an overall length B and separated from one another by gaps 11 having a length equal to approximately B/3. These bars 9 abut one another in the direction D in at least the upper stretch of the platform to form rigid tables 27 on which the various operations described below can take place. A motor 28 operated by a controller 29, which also operate the welder 2, cutter 3, stacker 4, puncher 5, and flattener 17, drives the platforms 27 of the conveyor 8.

Figure 2:
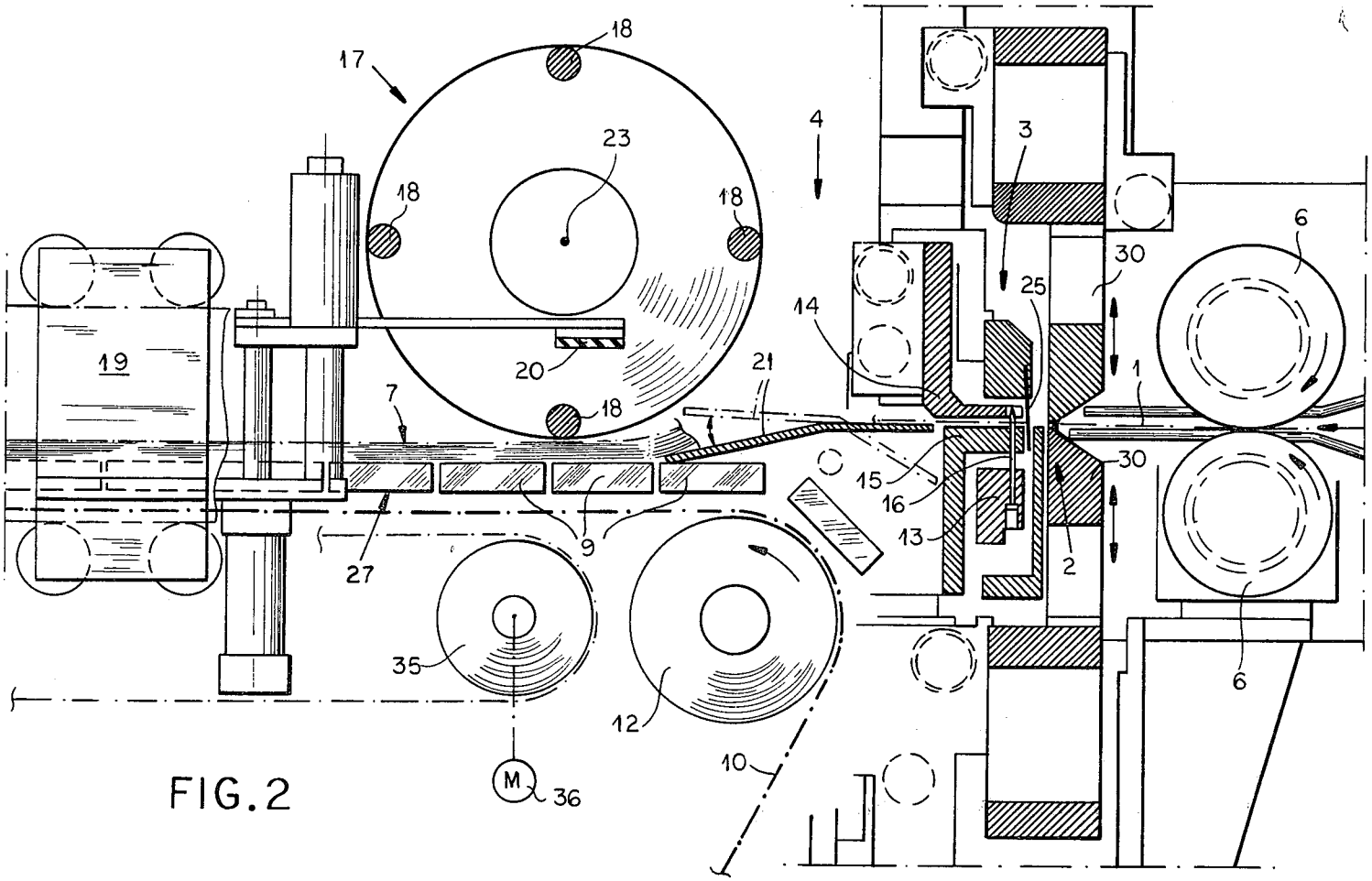
FIGS. 2 and 3 are large-scale views of the details indicated at II and III, respectively, in FIG. 1.

The welder 2 comprises as best seen in FIG. 2 a pair of vertically oppositely reciprocal welding bars 30 capable of forming a throughgoing transverse weld across the tube 1. This welder 2 is operated synchronously with the cutter 3 by the controller 29. The cutter 3 in turn comprises a vertically reciprocal blade 25 slightly downstream of the welding bars 31 and moved synchronously therewith but slightly later in time, so that the cut is only made after the weld has been formed.

The stacker 4 includes immediately downstream of the blade 25 a pin bar 13 carrying a plurality of needles 16 one of which is heated to a temperature above the melting point for the synthetic-resin of the tube 1. Jointly vertically reciprocal with the blade 25 is a notched anvil 14 for the needle bar 13 so that as the blade 25 descends the upstream edge of the bag blank that the blade 25 is cutting off the tube 1 is pressed down over the needles 16 so that they pierce it and these needles 16 hold the bag blank once it is freed by the blade 25 from the tube 1. A stripper bar 15 is provided underneath the path and surrounding the needles 16 but is only displaced upwardly periodically, normally after a predetermined number such as twenty-five or fifty bag blanks 1' have been cut from the tube 1. Otherwise a stack 7 is formed extending downstream from the cutting station, with the upstream edges of the bag blanks in the stack 7 being pierced by the needles 16 to hold these bag blanks 1' relative to one another. In addition it is noted that the one or more heated needles 16 blocks together the stack 7.

The smoother 17 comprises a pair of end plates 22 bridged by pins 18 and rotatable about an axis 23. These pins 18 each extend only about one-third of the way across the transport path in a direction perpendicular to the page as seen in FIG. 2 for reasons described below. In any event this smoothing device 17 is rotated continuously about is axis 23 so that as each bag blanks 1' is cut from the tube 1 it is flattened out on top of the stack 7, with the element 18 driving all of the air out of the bag blanks and out from between them.

The controller 29 meanwhile holds one of the platforms 27 immediately downstream from this stacker 24 so that the stacker 4 is laid on this rigid platform 27 which, therefore, provides excellent support for the stack 7.

Figure 3:
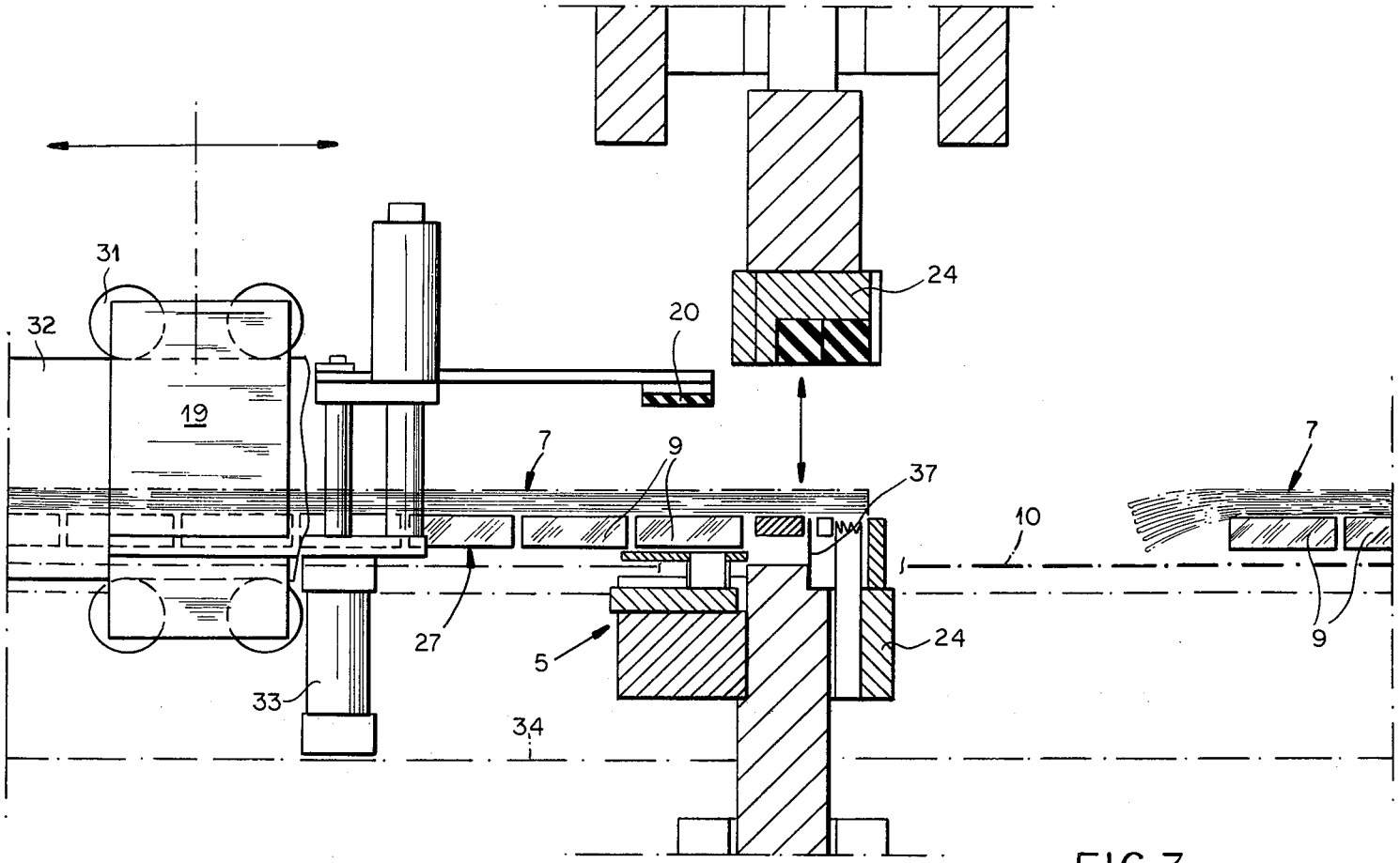
Figure 5:
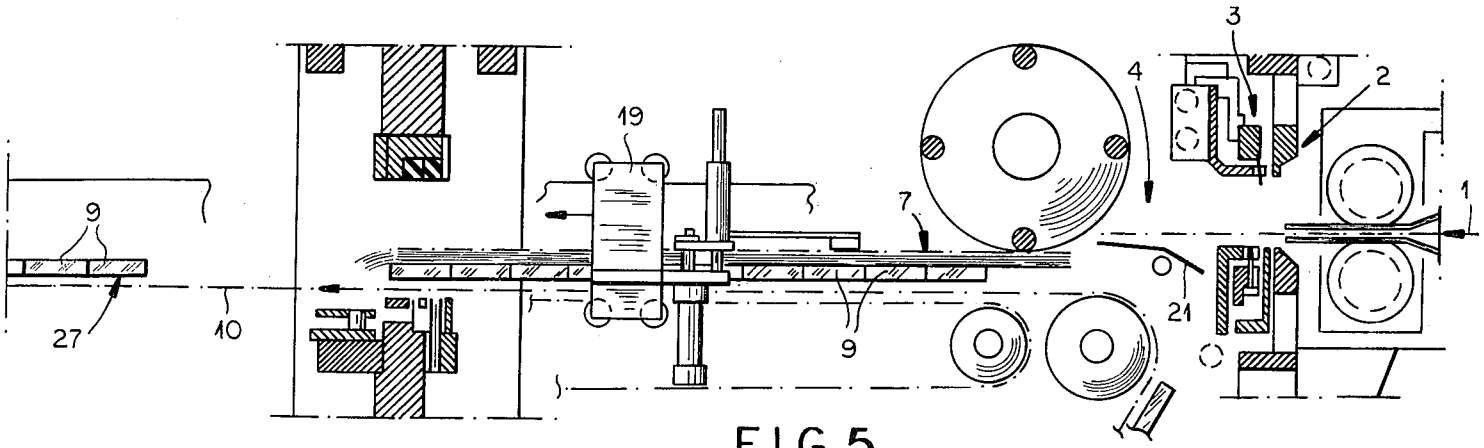
Figure 6:
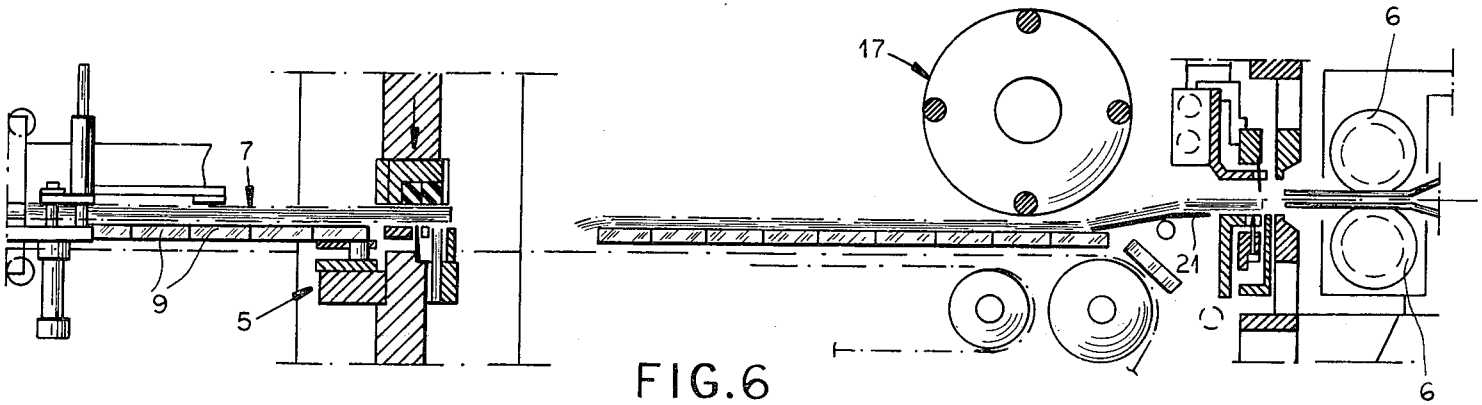

As best seen by a comparison of FIGS. 2 and 3 a gripper carriage 19 is provided with a gripper arm 20 extending upstream. This carriage 19 rides via wheels 31 on a rail 32 and is provided with a pneumatic cylinder 33 that can vertically displace the gripper element 20. In addition a chain 34 extending over rollers 35 at the upstream and downstream end of the upper stretch of the conveyor 8 is connected to the carriage 19 and is operated by a motor 36 operated in turn by the controller 29. This gripper carrriage 19 is used to transport stacks 7 from underneath the flattening device 17 to the puncher 5. Thus once a sufficiently large stack 7 is formed underneath the flattening device 17 the stripper bar 15 is displaced upwardly to push the upstream edges of the bag blanks 1' off the pins 16. Simultaneously the gripper element 20 is brought down into engagement with the top of the stack 7, pressing it down onto the platform 27. The gaps between the inner ends of the pins 19 allow this element 20 to move from a position upstream of the flattener 17 to a position downstream of the puncher 5. The conveyor 8 and carriage 19 are then jointly displaced so that the stack 7 is held tightly against the platform 27 and displaced downstream into a position with its upper edge underneath the puncher 5 as shown in FIG. 3. Meanwhile the controller 29 pivots the deflecting plate 21 extending between the stripper bar 15 and the upstream edge of the conveyor 8 upwardly so that the newly arriving end of the tube 1 is not gripped by the gripping element 20, but instead is fed over the top of it so that as the stack 7 is pulled out of the way the new bag blank is set on the next platform 27.

The puncher 5 shown in FIG. 3 comprises a U-shaped blade 37 and oppositely vertically reciprocal holding bars 24 that move toward each other to grip and cut a section out of the upstream edge of the stack 7. This section is inward of the two longitudinal edges of the stack 7 so that two handles are formed. Simultaneously it is also possible for this arrangement to weld together the upper edges of the handles. Similarly it is also possible for this blade 37 to merely cut off more portion of the upstream edge, or to form perforations in it. Such a structure is well known in the art.

After being thus cut the blocked stack 7 of bags can be pass to a station where it is loaded into a boxing manner once again also well known in the art.

The instant invention therefore allows bags to be made of extremely thin film. This system is set up so that the relatively delicate and hard-to-handle bag blanks are at all times positively engaged by some structural element. While they are being stacked they are pierced by the pins 16 so that the flattener 17 can form a neat stack 7. This stack 7 is only stripped from the pins 16 after it has been held down on its platform 27 by the gripper element 20, and then is held between the holding bars 24 while the blade 37 of the puncher 5 is operated by the controller 29 to cut out the space between the handles. The gripper 20 moves to the extreme upstream end of the platform 27, and the extreme upstream end of the platform 27 is positioned immediately downstream of the punching blade 37 so that at all times the stack 7 is positively held and supported.

I claim:

1. An apparatus for making bags from an elongated synthetic-resin tube, said apparatus comprising:

an endless conveyor having a stretch defining a transport path extending in a transport direction from an upstream cutting/welding station through a stacking station and a flattening station, to a downstream punching station, said conveyor having an endless support element and a plurality of groups of transverse rigid bars forming along said path a plurality of respective platforms having predetermined lengths in said direction and spaced apart by gaps, the bars of each platform engaging one another in said direction;

means for feeding said tube generally continuously in said direction to said upstream cutting/welding station;

cutting/welding means in said cutting/welding station for periodically transversely cutting through said tube and generally simultaneously forming upstream of each cut a transversely throughgoing weld for subdividing said tube into a succession of bag blanks;

stacking means in said stacking station including a transversely reciprocal needle bar provided with a plurality of needles including at least one blocking needle, and a transversely reciprocal stripper bar through which said needles engage;

control means for synchronously operating said conveyor, cutting/welding means, and stacking means for piercing said needles through the upstream edge of each of said bag blanks as same is cut free from said tube while supporting each said bag blanks as same are cut free from said tube on a one of said platforms and for, after a predetermined number of operations of said cutting/welding means, stripping said bag blanks off said needles with said stripper bar and operating said conveyor to displace the stack of bag blanks stripped from said needles downstream to said punching station;

flattening means in said flattening station having a plurality of flattening elements for engaging each of said bag blanks as same is cut free from said tube and pressing same flatly down against the platform supporting it;

a gripper carriage displaceable in and against said direction and having a holding element displaceable vertically toward and away from said stretch, said control means being connected to said carriage to press said holding element down against said stack of bags blanks as same are stripped from said needle bar and for thereafter displacing said carriage synchronously and codirectionally with the platform supporting said stack downstream to said punching station;

punching means at said punching station for punching said stacks of bag blanks as same arrive, said punching station being spaced in said direction downstream of said welding/cutting station by a distance substantially greater than said predetermined length of said; and a deflecting plate at said stacking station, said control means being connected to said plate for pivoting said plate by and deflecting a new tube end over a stack when same is engaged by said gripper element.

2. The apparatus defined in claim 1 wherein said bars are releasably secured to said support element, whereby the length of said platforms can be varied.

3. The apparatus defined in claim 1 wherein said flattening means includes at least one disk rotatable about an axis transverse to said direction and parallel to said platforms, said disk carrying said elements and being rotatable about said axis by said control means.

4. The apparatus defined in claim 1 wherein said punching means is provided with vertically reciprocal holding bars engageable with a stack in said punching station to hold same during punching.

5. The apparatus defined in claim 1 wherein said predetermined length is shorter than the corresponding dimension of said bag blank.

6. The apparatus defined in claim 1 wherein said control means operates said conveyor step-wise.

* * * * *